US010024164B2

(12) United States Patent
Miller et al.

(10) Patent No.: US 10,024,164 B2
(45) Date of Patent: Jul. 17, 2018

(54) FIXTURE FOR RESTRAINING A TURBINE WHEEL

(71) Applicant: General Electric Company, Schenectady, NY (US)

(72) Inventors: Maxwell Evan Miller, Simpsonville, SC (US); Jason Matthew Clark, Maryville, TN (US); Sandra Beverly Kolvick, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 23 days.

(21) Appl. No.: 15/277,327

(22) Filed: Sep. 27, 2016

(65) Prior Publication Data

US 2018/0087383 A1 Mar. 29, 2018

(51) Int. Cl.

*F01D 5/00* (2006.01)
*F01D 5/30* (2006.01)
*F01D 5/32* (2006.01)

(52) U.S. Cl.

CPC ..... *F01D 5/005* (2013.01); *F01D 5/3007* (2013.01); *F01D 5/32* (2013.01); *F05D 2220/32* (2013.01);

(Continued)

(58) Field of Classification Search

CPC ..... Y10T 403/7094; Y10T 403/70; F01D 25/243; F01D 25/285; F01D 5/02;

(Continued)

(56) References Cited

U.S. PATENT DOCUMENTS 3,721,506 A * 3/1973 Anderson ..... F01D 5/3038 416/215
4,630,982 A * 12/1986 Fenner ..... B61D 45/001 24/265 CD (Continued)

FOREIGN PATENT DOCUMENTS

EP 2 752 382 A1 7/2014
EP 2 921 657 A1 9/2015

(Continued)

OTHER PUBLICATIONS

International Search Report and Written Opinion issued in connection with corresponding PCT Application No. PCT/US2017/049106 dated Nov. 14, 2017.

*Primary Examiner* — Josh Skroupa
*Assistant Examiner* — Cory B Siegert
(74) *Attorney, Agent, or Firm* — James W. Pemrick; Ernest G. Cusick; Frank A. Landgraff

(57) ABSTRACT

A fixture for restraining a wheel of a turbomachine has a dovetail section adapted for insertion into a dovetail slot of the wheel. A mounting section is located adjacent to, or formed integrally with, the dovetail section. At least one coupling ring is attached to the mounting section, and the coupling ring is adapted to be secured to a stationary anchoring point via a restraint. The stationary anchoring point includes at least one counterbore assembly having a coupling ring attached thereto. The counterbore assembly is adapted to be secured to a stationary structure. The stationary structure may be a shell, a flange or a casing of the turbomachine.

7 Claims, 8 Drawing Sheets

(52) U.S. Cl.
CPC ..... *F05D 2230/72* (2013.01); *F05D 2260/02* (2013.01); *F05D 2260/30* (2013.01)

(58) Field of Classification Search
CPC ..... F01D 2220/32; F05D 2260/30; F05D 2230/60; F05D 2230/72; F05D 2230/68; F05D 2230/80; B27F 1/08; E04B 2/08; E04B 2/18; E04B 2/32; E04B 2/46; E04B 2001/2624; E04B 2001/2628; E04B 2001/2632; E04B 2002/0252; F04D 29/644; F05B 2260/30; F05B 2230/60; F05B 2230/61; F05B 2230/80; A47B 2230/0077
USPC ..... 403/381, 345
See application file for complete search history.

(56) References Cited

U.S. PATENT DOCUMENTS 5,284,406 A 2/1994 Mueller et al.
6,016,600 A * 1/2000 Kennell ..... B23P 6/002 29/889.1
6,638,006 B2 * 10/2003 Selby ..... F01D 5/3038 415/9
8,267,664 B2 * 9/2012 Tipton ..... F01D 5/326 416/220 A
8,414,268 B2 * 4/2013 Aiello ..... F01D 5/32 416/215
9,429,041 B2 * 8/2016 Holmes ..... B25B 27/14
9,745,995 B2 * 8/2017 Jevons ..... F04D 29/34
2015/0110635 A1 * 4/2015 Kain ..... F01D 5/3007 416/221
2016/0201556 A1 * 7/2016 Kolvick ..... F01D 5/3007 29/888.012
2017/0030222 A1 * 2/2017 De Sousa ..... F01D 25/162
2017/0218973 A1 * 8/2017 Bishop ..... F04D 29/30

FOREIGN PATENT DOCUMENTS

KR 10-2012-0092336 A 8/2012
WO WO-2015110749 A1 * 7/2015 ..... F01D 25/162

* cited by examiner

FIXTURE FOR RESTRAINING A TURBINE WHEEL

BACKGROUND OF THE INVENTION

The apparatus described herein relates generally to turbomachinery and, more specifically, to a fixture for restraining a turbine wheel during a blade removal or installation procedure.

Turbomachines need regular maintenance to keep up with the cycle type, in which some cases are continuous (6,000 hours/year or more). During an inspection maintenance outage, the blades in the turbine section of the turbomachine may need to be replaced. The top half of the turbine case is removed, and technicians will restrain the rotor from rolling and begin to remove or replace the turbine blades. To restrain the rotor, technicians have tied a strap around a blade and then attached it to somewhere in the turbine compartment. This known method could result in near miss or incidents which involve the rotor rolling due to a broken strap, as well as damage caused to the blade. The known method that uses a strap presents a risk of injury, safety concerns, as well as requiring possible replacement parts due to hardware damage.

BRIEF DESCRIPTION OF THE INVENTION

In an aspect of the present invention, a fixture for restraining a wheel of a turbomachine has a dovetail section adapted for insertion into a dovetail slot of the wheel. A mounting section is located adjacent to, or formed integrally with, the dovetail section. At least one coupling ring is attached to the mounting section, and the at least one coupling ring is adapted to be secured to a stationary anchoring point via a restraint.

In another aspect of the present invention, a fixture for restraining a wheel of a turbomachine includes a dovetail section adapted for insertion into a dovetail slot of the wheel. The dovetail section has a dovetail shaped profile or fir tree shaped profile adapted to interlock with corresponding notches or recesses in the dovetail slot of the wheel. The dovetail section has an aft end and a forward end, and both the aft end and the forward end have a threaded hole adapted for securing a fastener. A mounting section is located adjacent to, or formed integrally with, the dovetail section. The mounting section has at least one threaded hole adapted for attaching a coupling ring to the mounting section. A coupling fastener and a washer secures the coupling ring to the mounting section via the at least one threaded hole. The coupling ring is attached to the mounting section, and the at least one coupling ring is adapted to be secured to a stationary anchoring point via a restraint.

In yet another aspect of the present invention, a method for restraining a wheel of a turbomachine is provided. The method includes a step of inserting a fixture into a dovetail slot in the wheel. The fixture has dovetail section adapted for insertion into the dovetail slot, and a mounting section located adjacent to, or formed integrally with, the dovetail section. The mounting section is adapted to connect to at least one coupling ring. The inserting step may also include placing a washer over a fastener, and inserting the fastener into a threaded hole in the dovetail section, wherein the washer is adapted to extend over an axial face of the dovetail slot. In addition, the inserting step may include attaching the at least one coupling ring to the mounting section. An attaching step attaches at least one counterbore assembly to a stationary structure, and a connecting step connects a restraint to the at least one coupling ring and the at least one counterbore assembly. The connecting step may also include attaching a come-along or ratcheting mechanism having a strap, chain or cable to both the at least one coupling ring and the at least one counterbore assembly, and tightening the come-along or ratcheting mechanism to restrain the wheel. The stationary structure may be a shell, a flange or a casing of the turbomachine. The dovetail section may have a straight profile adapted for use with a straight dovetail slot, or an angled profile adapted for use with an angled dovetail slot, or a curved profile adapted for use with a curved dovetail slot.

DETAILED DESCRIPTION OF THE INVENTION

One or more specific aspects/embodiments of the present invention will be described below. In an effort to provide a concise description of these aspects/embodiments, all features of an actual implementation may not be described in the specification. It should be appreciated that in the development of any such actual implementation, as in any engineering or design project, numerous implementation-specific decisions must be made to achieve the developers' specific goals, such as compliance with machine-related, system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," and "the" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "one aspect" or "an embodiment" or "an aspect" of the present invention are not intended to be interpreted as excluding the existence of additional embodiments or aspects that also incorporate the recited features.

Figure 1:
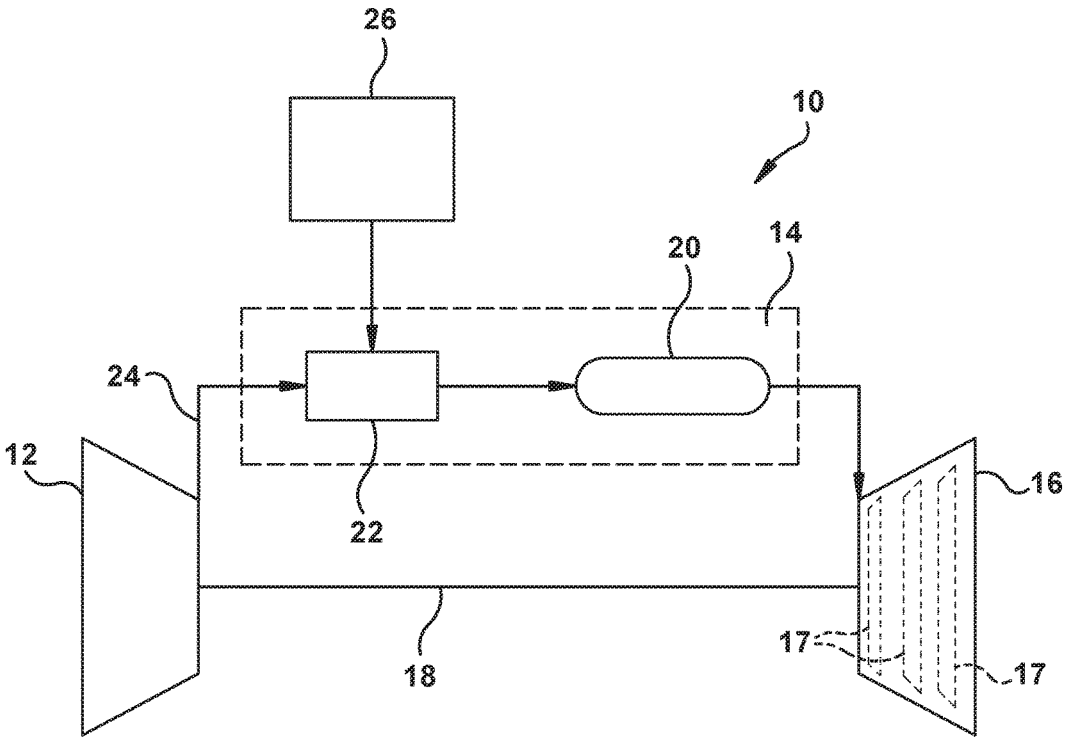
FIG. 1 is a schematic illustration of a gas turbine system.

Referring to FIG. 1, a turbomachine, such as a gas turbine, is schematically illustrated with reference numeral 10. The gas turbine 10 includes a compressor 12, a combustor assembly 14, a turbine 16, and a shaft 18. It is to be appreciated that one embodiment of the gas turbine 10 may include a plurality of compressors 12, combustor assemblies 14, turbines 16 and/or shafts 18. The compressor 12 and the turbine 16 are coupled by the shaft 18. The shaft 18 may be a single shaft or a plurality of shaft segments coupled together to form the shaft 18.

The combustor assembly 14 uses a combustible liquid and/or gas fuel, such as a natural gas or a hydrogen rich synthetic gas, to run the gas turbine 10. The combustor assembly 14 includes a combustor chamber 20 that is in fluid communication with a fuel pre-mixer 22 that is in fluid communication with an airflow 24 and a fuel source 26. The fuel pre-mixer 22 creates an air-fuel mixture, and discharges the air-fuel mixture into the combustor chamber 20, thereby causing a combustion that creates a hot pressurized exhaust gas. The combustor chamber 20 directs the hot pressurized gas through a transition piece into the turbine 16, causing rotation of the turbine 16. Rotation of the turbine 16 causes the shaft 18 to rotate, thereby compressing air as it flows into the compressor 12. The turbine section 16 has multiple rotatable wheels 17 on which a plurality of blades are mounted. In this example, three stages of turbine wheels 17 are shown, and each wheel would be paired with a stator vane stage (not shown). In general, turbomachines include, compressors, gas turbines and steam turbines.

Figure 2:
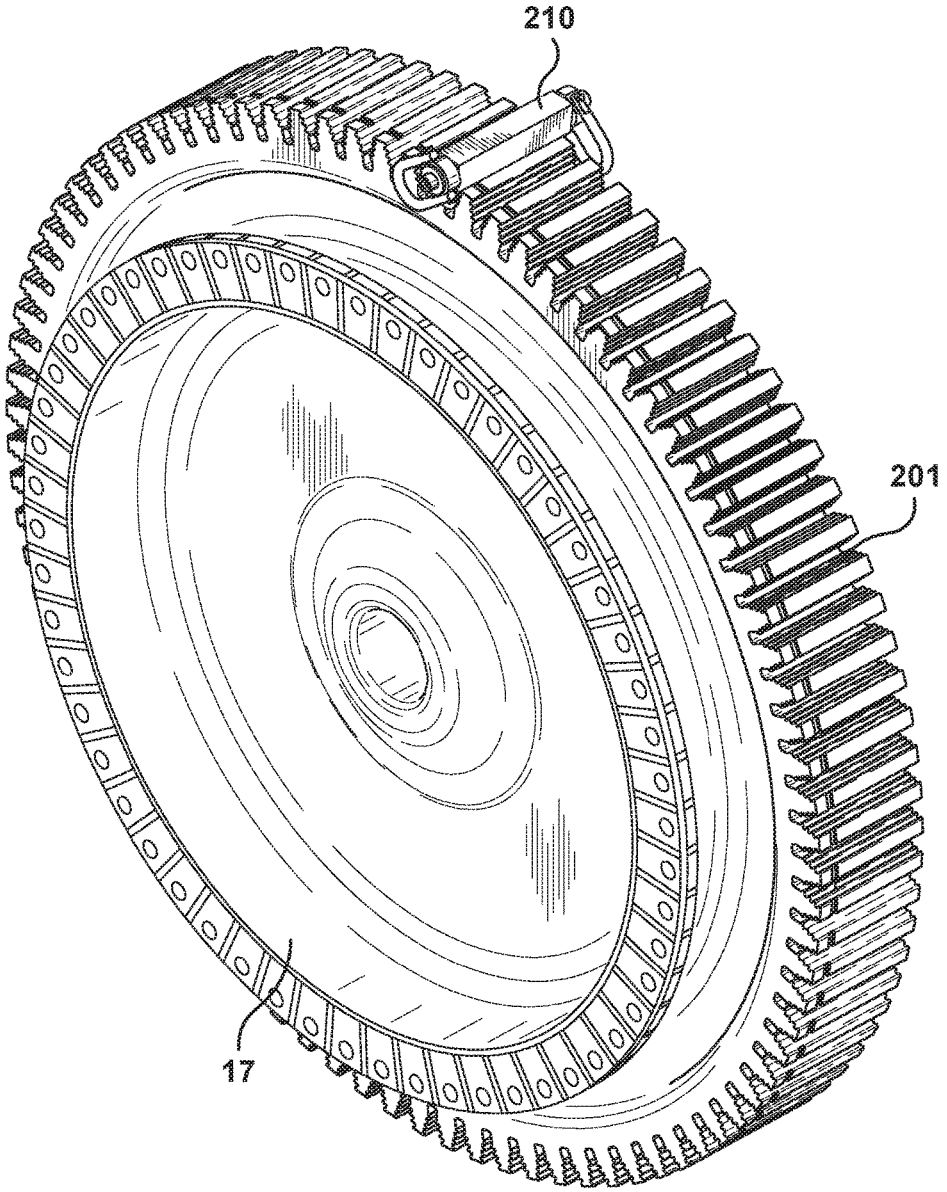
FIG. 2 illustrates a perspective view of single turbine wheel.

FIG. 2 illustrates a perspective view of single turbine wheel 17. The wheel 17 includes a series of circumferentially arranged dovetail slots 201. A turbine blade (not shown) is inserted into each of these dovetail slots 201. During service (or assembly) of the turbomachine 10, the blades may need to be removed or installed. In a service example, the blades are removed and the used blades are either repaired and re-installed or just replaced with new blades. Turbomachines, such as gas or steam turbines, have large and heavy components. The wheel 17 with blades attached is one example of a heavy component, and this wheel is balanced to reduce vibrations. However, as the blades are removed from wheel 17, the wheel's center of gravity changes, and the wheel will want to rotate in either a clockwise or counter-clockwise direction. This can present a serious safety hazard to people working on the turbine, as an unexpected wheel rotation can force a blade (or other wheel component) onto personnel. Therefore, it would be desirable to restrain the rotor from rotation during a blade removal or installation procedure. A fixture 210 for restraining the wheel 17 is the focus of this disclosure, and will be described in greater detail hereinbelow.

Figure 3:
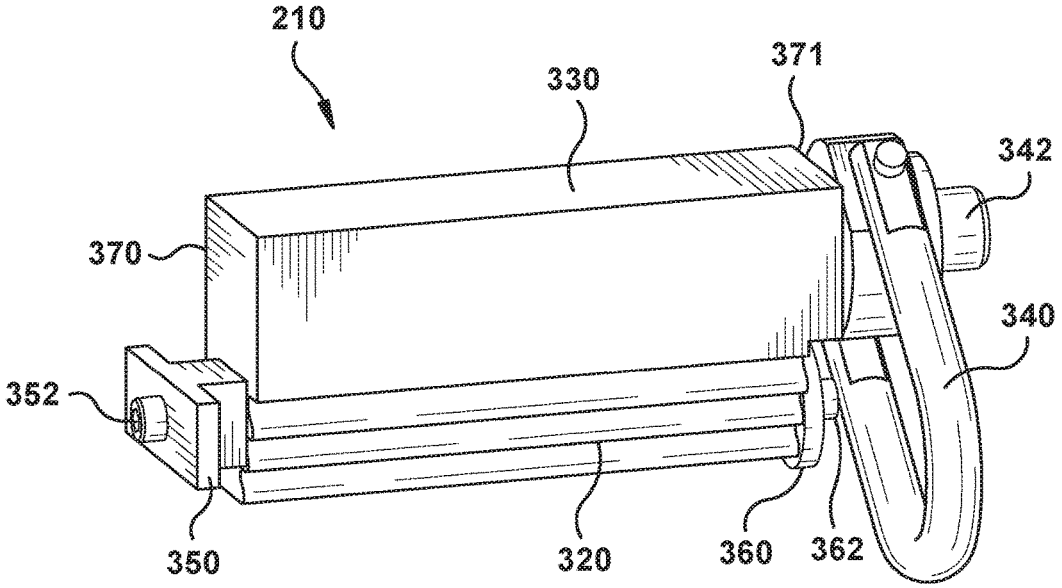
FIG. 3 illustrates a perspective view of a fixture for restraining a wheel of a turbomachine, according to an aspect of the present invention.

FIG. 3 illustrates a perspective view of the fixture 210 for restraining a wheel 17 of a turbomachine 10. The fixture 210 includes a dovetail section 320 adapted for insertion into the dovetail slot 201 of the wheel 17. The dovetail section 320 has a dovetail shaped profile or fir tree shaped profile, which include a plurality of ridges and valleys, adapted to interlock with corresponding notches or recesses in the dovetail slot 201 of wheel 17. Typically, the peak height of each ridge decreases in height as the peaks become nearer to the bottom (radially inner portion) of the dovetail section. A mounting section 330 is located on top of and adjacent to, or formed integrally with, the dovetail section 320. In one example, the dovetail section 320 and mounting section 330 are cast as, or machined from, a single piece of material, and this material may be 4140-HT (heat treated) high alloy tool steel as it has good strength, toughness, and mechanical properties. Alternatively, any other suitable material may be used as desired in the specific application. Fixture 210 also includes at least one coupling ring 340 attached to the mounting section 330. The coupling ring 340 may be a hoist ring, shackle or other suitable coupling device. A fastener 342, such as a shoulder head screw with washer, may be used to attach the coupling ring 340 to the mounting section 330. The coupling ring 340 may be attached so that it swivels about an axial axis, and so that it can be oriented as shown in FIG. 3 or FIG. 4, or any position in between the illustrated positions.

In use, the coupling ring 340 is secured to a stationary anchoring point via a restraint. To lock the fixture into the dovetail slot 201, stops 350, 360, 450 are used on axial ends or axial faces thereof. The fixture 210 has a forward axial face (or end) 370 and an aft axial face (or end) 371. The stop 350 is configured as a T-shaped stop and the top of the "T" extends past the outline of the dovetail slot 201. In this manner, the stop 350 rests against a forward axial face of wheel 17 and prevents axial movement of the fixture. The stop 350 is attached to the dovetail section 320 by means of a fastener 352, such as a shoulder screw or bolt. The aft axial face 371 has a fastener 362 and washer 360 that function as a stop. The washer 360 is sized so that it overlaps the dovetail slot boundary, and in so doing prevent axial movement of the fixture. When both stops 350, 360 are installed, the dovetail section 320 is locked in the dovetail slot 201, and the fixture will not slide out of the slot 201.

Figure 4:
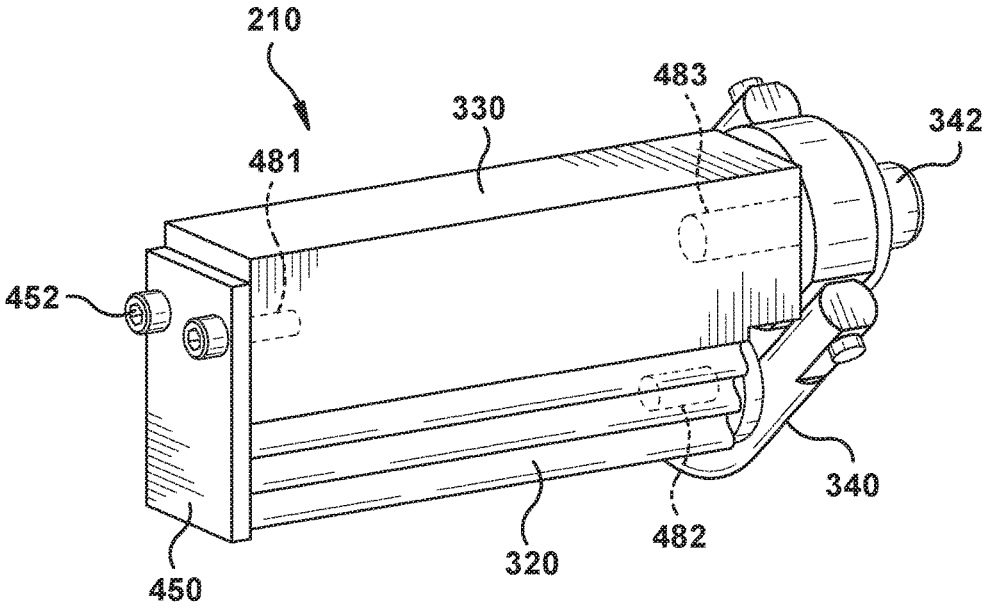
FIG. 4 illustrates a perspective view of the fixture for restraining a wheel of a turbomachine, according to an aspect of the present invention.

FIG. 4 illustrates a perspective view of the fixture 210 for restraining a wheel 17 of a turbomachine 10. Wheels 17 may have varying thicknesses. A thicker wheel may require a stop 350 as shown in FIG. 3. However, for a thinner wheel a stop 450 may be used. Stop 450 is comprised of a plate having holes for one or more fasteners 452. The fasteners 452 may be configured to screw into an axial face of mounting section 330 (as shown) and/or into dovetail section 320. As an example only, the axial length of the dovetail section 320 and mounting section 330 may be sized to match the thinnest wheel of the target turbomachine. In this manner, T-stops 350 may be used to adjust the fixture to thicker wheels, and the stop plate 450 may be used on the thinnest wheel. The various stops 350, 450, 360 may also be fabricated from 4140-HT (heat treated) high alloy tool steel, or any other suitable material. In addition, both the aft end and the forward end have one or more internally threaded holes 481, 482 adapted for securing fasteners. The mounting section 330 includes at least one internally threaded hole 483 adapted for attaching the coupling ring 340 to the mounting section 330, and fastener 342 and an optional washer secures the coupling ring 340 to the mounting section 330 via the threaded hole 483.

Figure 5:
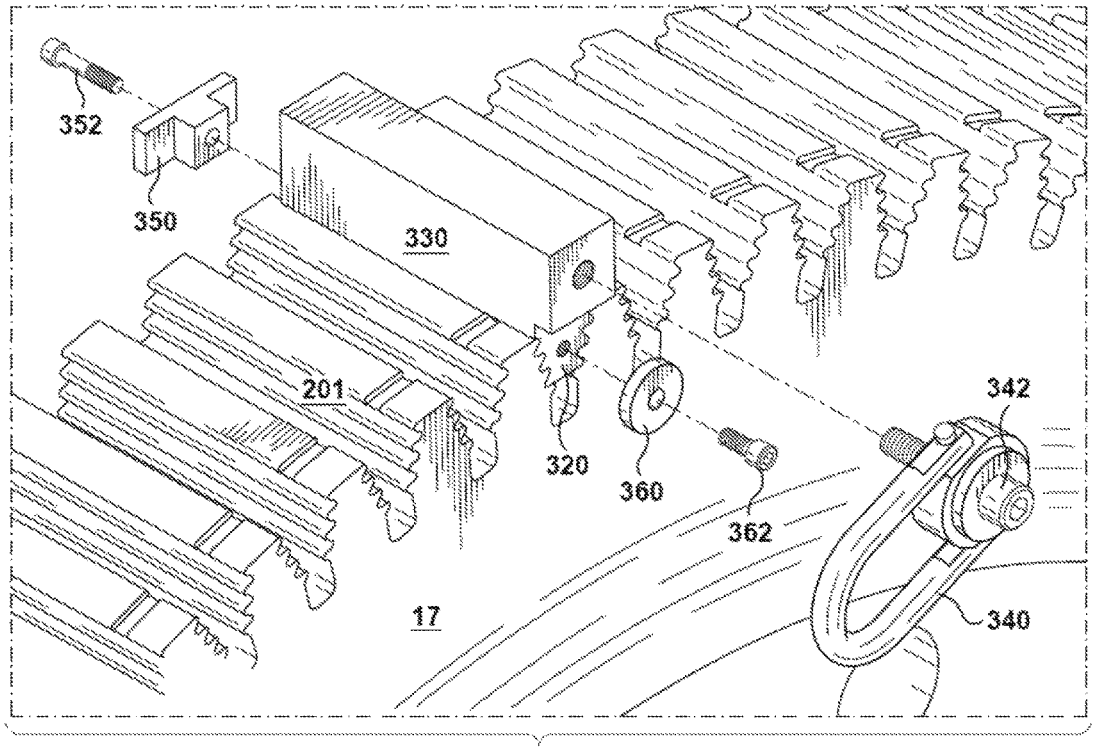
FIG. 5 illustrates an exploded, perspective view of the fixture in a dovetail slot of a wheel, according to an aspect of the present invention.

FIG. 5 illustrates an exploded, perspective view of the fixture 210 in a dovetail slot 201 of a wheel 17 of a turbomachine. The fixture 210 is inserted into the dovetail slot 201 and is restrained from moving radially or circumferentially. However, the fixture could slide out axially forward or aft. To prevent this, axial stops are installed. The forward axial stop 350 is attached/secured to the forward side of the fixture. The aft axial stop 360 is then installed on the aft side of the fixture. When both stops are installed the fixture is locked to the wheel. The coupling ring 340 may then be attached to the mounting section 330. It is to be understood that one or more coupling rings may be used, for example, one coupling ring on each axial face/end of the fixture, or one or more coupling rings may be located on the top (or radially outer surface) of the mounting section 330, or any combination thereof. As shown in FIG. 5 dovetail section 320 has a straight profile adapted for use with a straight dovetail slot 201.

Figure 6:
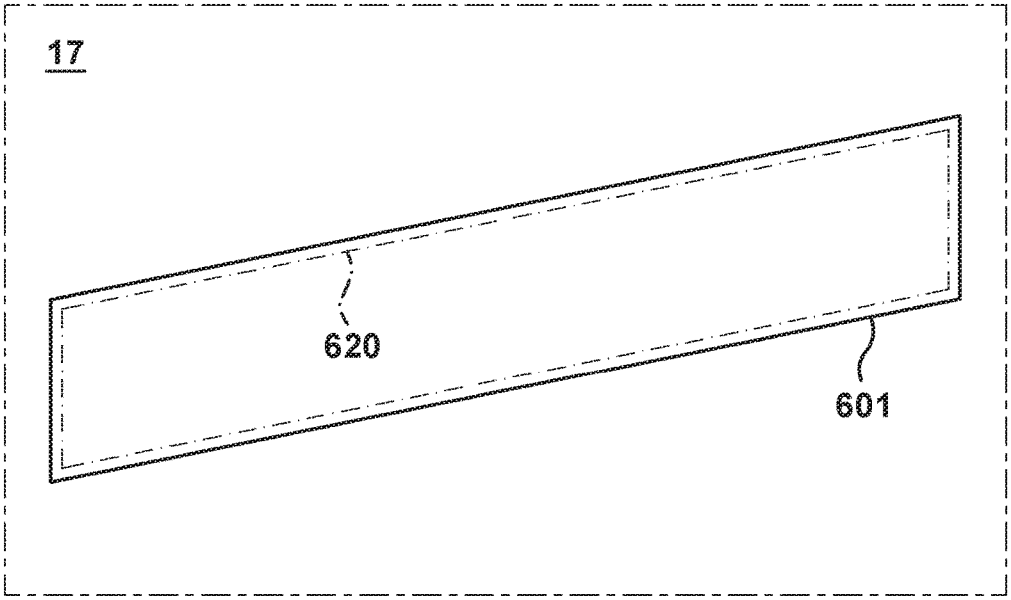
FIG. 6 illustrates a top, cross-sectional view of the fixture located in a dovetail slot.
Figure 7:
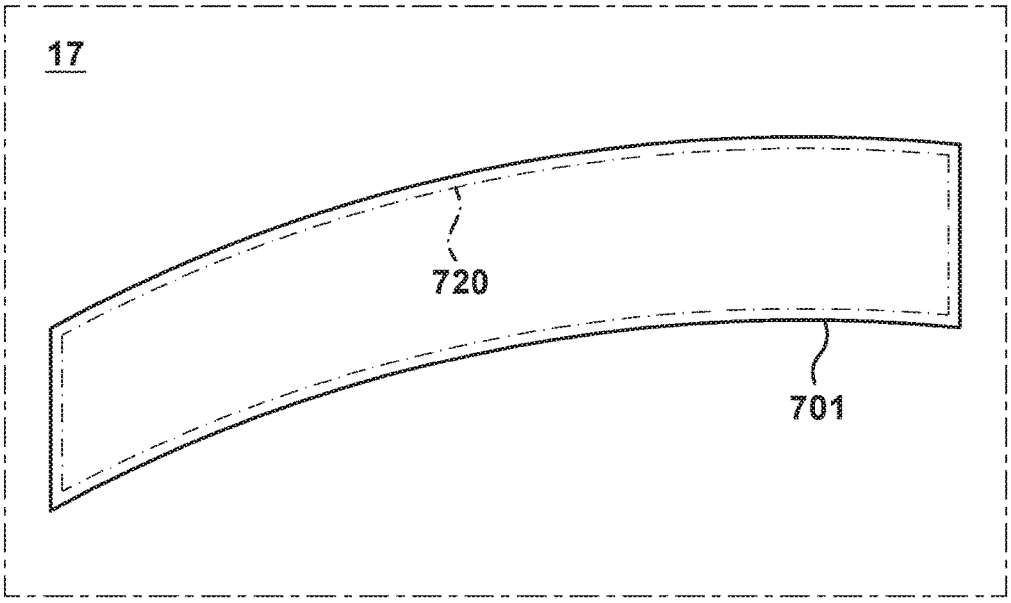
FIG. 7 illustrates a top, cross-sectional view of the fixture located in a curved, axial-entry type of dovetail slot.

FIG. 6 illustrates a top, cross-sectional view of the fixture located in a dovetail slot. The dovetail section 620 has an angled profile adapted for use with an angled dovetail slot 601. The axial extending sides of slot 601 are not orthogonal to the axial faces thereof. FIG. 7 illustrates a top, cross-sectional view of the fixture located in a dovetail slot. The dovetail section 720 has a curved profile adapted for use with a curved dovetail slot 701. This curved, axial-entry type of configuration may be used in steam turbines, or any other turbomachine as desired.

Figure 8:
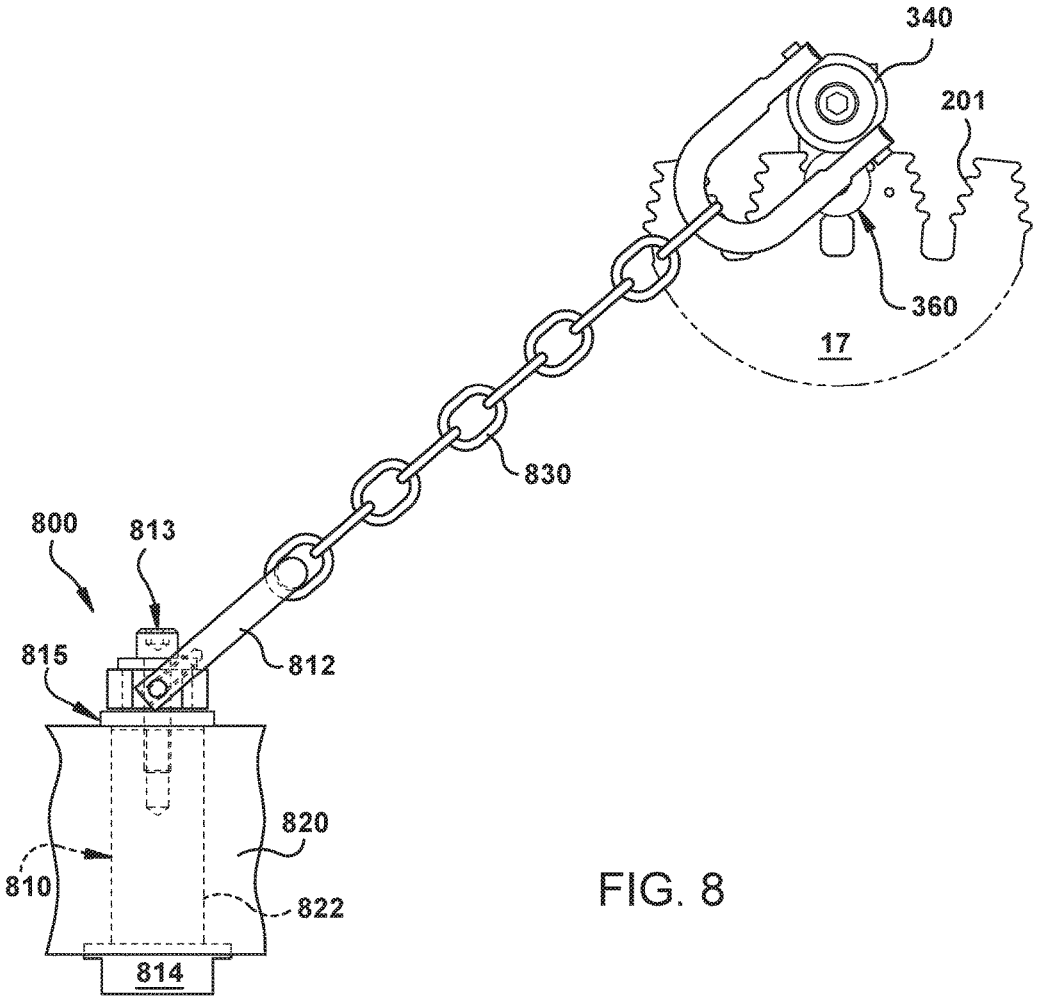
FIG. 8 illustrates a partial side view of the fixture installed in a wheel and connected to a stationary anchoring point on the turbomachine's casing.

FIG. 8 illustrates a partial side view of the fixture installed in a wheel and connected to a stationary anchoring point on the turbomachine's casing. The stationary anchoring point 800 may include at least one counterbore assembly 810 having a coupling ring 812 attached thereto. The counterbore assembly 800 is adapted to be secured to a stationary structure 820, such as a turbomachine casing, shell or flange. In the example shown, the stationary structure 820 is the bottom half of a turbine case. The counterbore assembly 810 has a counterbore insert 814 that has a portion adapted to extend into a hole 822 of the turbine case 820. A head of the counterbore insert 814 is larger than the hole 822 diameter. The shaft portion of the counterbore insert (the portion that goes into the turbine casing hole 822) includes an internally threaded hole that is configured for use with fastener 813. Alternatively, the counterbore insert may be a cylindrical element having two opposing internally threaded holes, one for use with fastener 813 and another for a bolt (e.g., which would take the place of 814). The fastener 813 connects the coupling ring 812 to the counterbore insert 814, and therefore to the turbine case 820. If desired a washer 815 may be interposed between the turbine case 820 and coupling ring 812. The coupling ring 340 is secured to the coupling ring 812 on stationary anchoring point 800 by restraint 830, which may be a chain, chain with come-along, cable or wire. Come-alongs may also be referred to as ratchet pullers, ratchet mechanisms or cable (or chain) pullers. Lever chain hoists or similarly functioning devices may be used as well for restraint 830.

Figure 9:
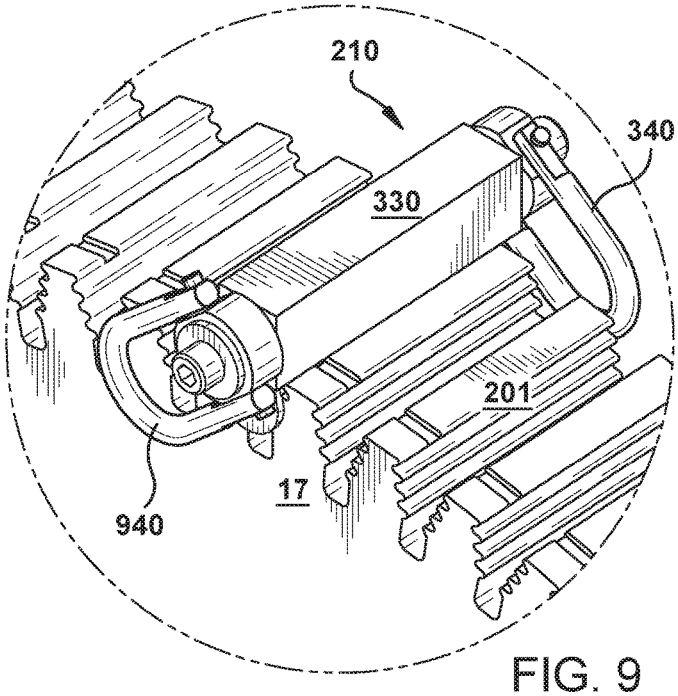
FIG. 9 illustrates a perspective view of the fixture located in a dovetail slot of a wheel of a turbomachine.

FIG. 9 illustrates a perspective view of the fixture 210 in a dovetail slot 201 of a wheel 17 of a turbomachine. The fixture 201 includes two coupling rings 340 and 940. Coupling ring 940 is attached to a forward end of the mounting section and is located on a forward axial side of the wheel 17, and coupling ring 340 is attached to an aft end of the mounting section and is located on the aft axial side of wheel 17. This type of configuration allows two restraints 830 to be attached to the fixture. The restraints may extend in the same direction, or extend in generally opposing directions.

Figure 10:
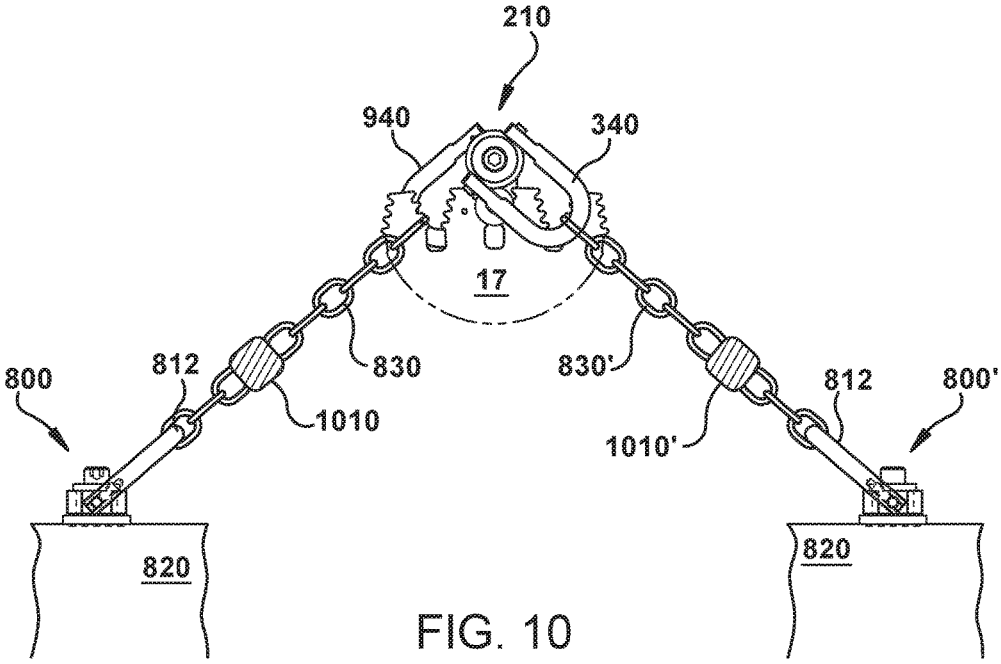
FIG. 10 illustrates a partial side view of the fixture of FIG. 9 installed in a dovetail slot of wheel, and the fixture is connected to two stationary anchoring points on the turbomachine's casing.

FIG. 10 illustrates a partial side view of the fixture 201 of FIG. 9 installed in a dovetail slot of wheel 17, and the fixture is connected to two stationary anchoring points on the turbomachine's casing. The first stationary anchoring point 800 is connected to the fixture 210 via restraint 830 (shown by a dotted line). The second stationary anchoring point 800' is connected to the fixture 210 via restraint 830' (shown by a dotted line). The two stationary anchoring points 800, 800' may be on opposing sides of the turbine case. The restraints 830, 830' may be tightened by the use of a come-along 1010 or 1010'. However, the restraints 830 do not need to be excessively tightened, as simply taking up the slack will be sufficient to prevent or restrain undesired wheel rotation. It is also to be understood that one or more coupling rings could be attached onto the top of the mounting section 330.

Figure 11:
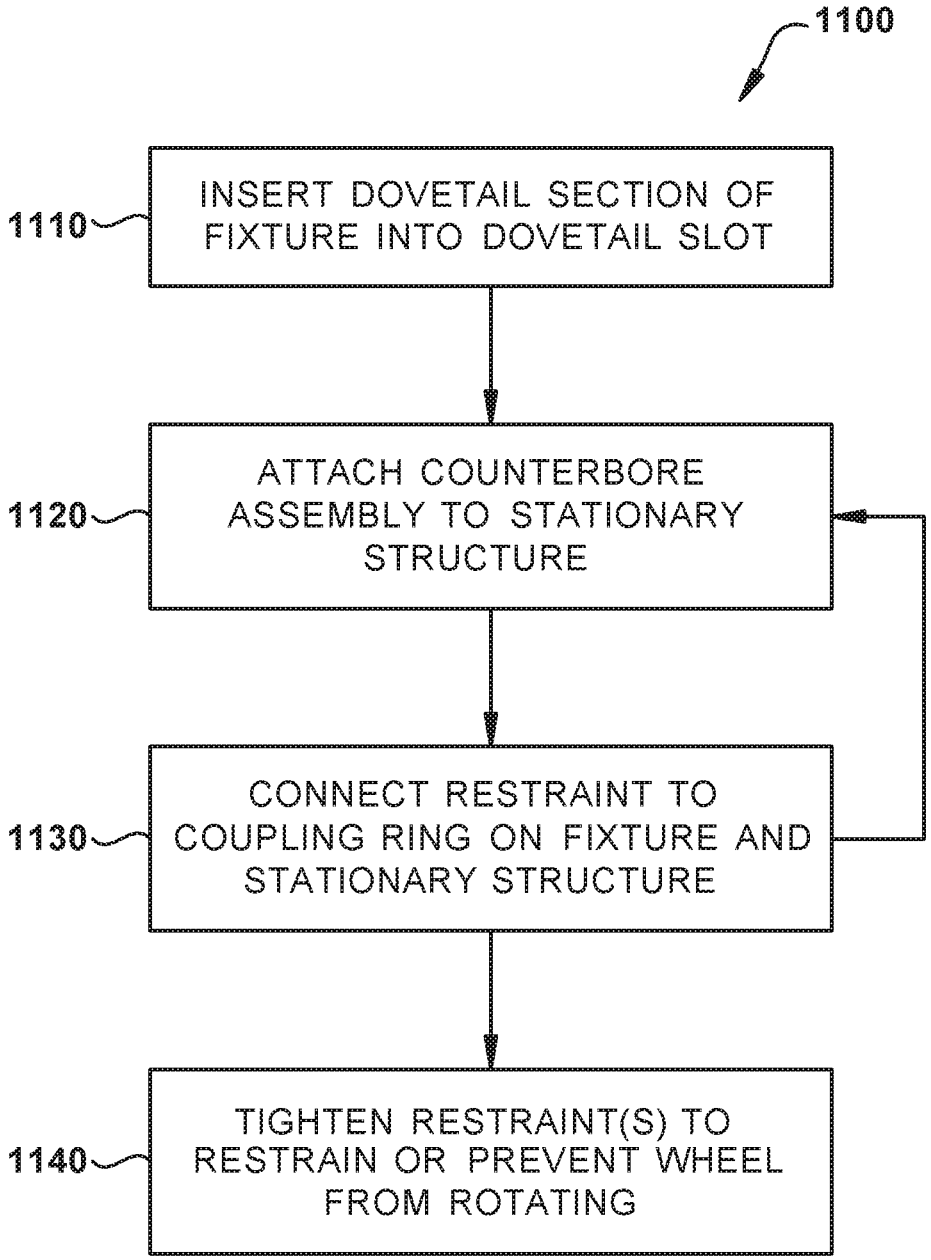
FIG. 11 is a flowchart for a method for restraining a wheel of a turbomachine.

FIG. 11 is a flowchart for a method 1100 for restraining a wheel 17 of a turbomachine. In step 1110 the fixture 210 is inserted into a dovetail slot 201 in the wheel 17. The fixture 210 includes a dovetail section 320 adapted for insertion into the dovetail slot 201, and a mounting section 330 located adjacent to, or formed integrally with, the dovetail section 320. The mounting section 330 is adapted to connect to at least one coupling ring 340. Step 1110 may also include placing a washer 360 over a fastener 362, and then inserting the fastener 362 into a threaded hole in the dovetail section 320. The washer is adapted to extend over or overlap an axial face of the dovetail slot 201. In addition, at least one coupling ring 340 may be attached to the mounting section 330 or the fixture 210 in general.

In step 1120, at least one counterbore assembly 810 is attached to a stationary structure 820. In step 1130 a restraint 830 is connected to the coupling ring 340 and the at least one counterbore assembly 810. Steps 1120 and 1130 may be repeated until the desired number of restraints are installed. Connecting step 1130 may also include attaching a come-along 1010 having a strap, chain 830 or cable to both the coupling ring 340 and the counterbore assembly 810 or other coupling ring 812 located on the stationary support. In step 1140, the restraints are tightened to restrain or prevent the wheel 17 from rotating.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A fixture for restraining a wheel of a turbomachine, the fixture comprising:

a dovetail section adapted for insertion into a dovetail slot of the wheel;

a mounting section located adjacent to, or formed integrally with, the dovetail section;

a first coupling ring attached to an aft end of the mounting section;

a second coupling ring attached to a forward end of the mounting section; and wherein the first coupling ring and the second coupling ring are adapted to be secured to a stationary anchoring point via a restraint.

2. The fixture of claim 1, the dovetail section having a dovetail shaped or fir tree shaped profile adapted to interlock with corresponding notches or recesses in the dovetail slot of the wheel.

3. The fixture of claim 2, both the aft end and the forward end having a threaded hole adapted for securing a fastener.

4. The fixture of claim 1, the dovetail section having one of:

a straight profile adapted for use with a straight dovetail slot, or an angled profile adapted for use with an angled dovetail slot, or a curved profile adapted for use with a curved dovetail slot.

5. The fixture of claim 1, the mounting section further comprising:

at least one threaded hole adapted for attaching the coupling ring to the mounting section, and wherein a fastener secures the coupling ring to the mounting section via the at least one threaded hole.

6. A fixture for restraining a wheel of a turbomachine, the fixture comprising:

a dovetail section adapted for insertion into a dovetail slot of the wheel, the dovetail section having a dovetail shaped profile or fir tree shaped profile adapted to interlock with corresponding notches or recesses in the dovetail slot of the wheel, the dovetail section having an aft end and a forward end, both the aft end and the forward end having a threaded hole adapted for securing a fastener;

a mounting section located adjacent to, or formed integrally with, the dovetail section, a first coupling ring attached to an aft axial face of the mounting section, and a second coupling ring attached to a forward axial face of the mounting section; the mounting section having threaded holes adapted for attaching the first coupling ring and the second coupling ring to the mounting section, and wherein coupling fasteners secure the first coupling ring and the second coupling ring to the mounting section;

wherein the first coupling ring and the second coupling ring are adapted to be secured to a stationary anchoring point via a restraint.

7. The fixture of claim 6, the dovetail section having one of:

a straight profile adapted for use with a straight dovetail slot, or an angled profile adapted for use with an angled dovetail slot, or a curved profile adapted for use with a curved dovetail slot.

* * * * *